United States Patent [19]

Hacias

[11] 4,160,370

[45] Jul. 10, 1979

[54] WATER EMULSIFIABLE LUBRICANT AND COOLANT

[75] Inventor: Kenneth J. Hacias, Sterling Heights, Mich.

[73] Assignee: Oxy Metal Industries Corporation, Warren, Mich.

[21] Appl. No.: 741,901

[22] Filed: Nov. 15, 1976

[51] Int. Cl.[2] ..... C10M 1/44; C10M 3/38; C10M 5/24; C10M 7/24

[52] U.S. Cl. ..... 72/42; 252/34; 252/49.5; 252/32.5

[58] Field of Search ..... 72/42; 252/32.5, 34, 252/49.5

[56] References Cited

U.S. PATENT DOCUMENTS

| | | | |
|---|---|---|---|
| 2,825,693 | 3/1958 | Beaubien et al. | 252/32.5 |
| 3,496,104 | 2/1970 | Shimada et al. | 252/32.5 |
| 3,558,489 | 1/1971 | Matson | 252/32.5 |
| 3,933,661 | 1/1976 | Abrams et al. | 252/32.5 |
| 3,945,930 | 3/1976 | Sugiyama et al. | 252/32.5 |

*Primary Examiner*—Delbert E. Gantz
*Assistant Examiner*—Irving Vaughn
*Attorney, Agent, or Firm*—Arthur E. Kluegel; Richard P. Mueller

[57] ABSTRACT

A water emulsifiable lubricant and coolant for the cold forming of metal, as in the forming and stamping of sheet metal parts and in the drawing of wire. The composition has superior lubricant and coolant properties and also imparts some degree of corrosion protection for the part after forming. The composition contains oleic acid, an ethanolamine, a mixture of mineral oils or a mixture of mineral oil with a wax, and a mixture of emulsifiers. The emulsion is stable at various strengths and at pH values ranging from 7.0 to 9.5, thus being useful with various plated or coated metals, as well as with uncoated metals.

An example of the lubricant is as follows:

Lubricant (a) water base
(b) oleic acid
(c) ethanolamine
(d) heavy mineral oil
(e) dialkylphenoxypoly (ethyleneoxy) ethanol
(f) sodium salt of alkylpolyoxyethylene phosphate ester, and
(g) a member selected from the group consisting of light mineral oil, paraffin wax, oxazoline wax.

6 Claims, No Drawings

WATER EMULSIFIABLE LUBRICANT AND COOLANT

BACKGROUND OF THE INVENTION

In the drawing of metallic wire and in the stamping of sheet metal beverage cans and the like, the use of lubricant and coolant forming aids is well known. The purpose of such forming aids is to reduce the pressures required to "draw and iron" a beverage can from a flat metal disc or to reduce the force required and the heat generated during the drawing of a wire through a forming die. Also, they produce a physical lubricating barrier to prevent galling of the forming tools.

The problems of lubricating and cooling during such operations are compounded by the use of pre-coated metal which is then cold formed. For example, zinc or copper coated wire and plate cannot tolerate a lubricant-coolant having a pH in excess of about 8.0. A highly basic lubricant-coolant will react with the zinc or copper coating.

The application of reactive phosphate lubricants to steel forms a conversion coating with the base metal. Such lubricants include oil ingredients and inorganic conversion coating as a part of the lubricant film. The lubricant film, in the presence of coolant water, may form a deposit on the part which is difficult to remove after the drawing operation is complete.

Consequently, there is a demand in the cold forming industry for a lubricant-coolant in the form of a stable aqueous emulsion which is (1) an effective lubricant and coolant, (2) stable at various pH levels, (3) compatible with various, earlier applied, metal coatings, and (4) compatible with various oil based reactive coatings.

BRIEF DESCRIPTION OF THE INVENTION

The emulsion of the present invention is water-stable at various concentrations. It is normally supplied at about a 25% solids concentration in water and can be utilized as supplied or can be diluted with water to concentrations ranging downwardly to about 2% solids.

The emulsion contains oleic acid and an ethanolamine in generally stoichiometric proportions; a heavy mineral oil such as Valvata 85; a relatively light lubricant, such as a light mineral oil, a paraffin wax or an oxazoline wax; and a mixture of emulsifiers such as dialkylphenoxypoly (ethylene oxy) ethanol and a partial sodium salt of an alkylpolyoxy-ethylene phosphate ester.

The utilization of the two types of emulsifiers yields both oleophilic and hydrophilic emulsion forming characteristics and makes possible the formation of emulsions which are stable at widely variant pH values and which are effective to emulsify undesirable water-reaction products from earlier applied reaction coatings of various types.

The emulsion of the present invention, whether at full strength or as diluted, can be applied to the metal by any desired method. The emulsion can be applied by dipping the metal into the emulsion, by spraying onto the metal, or by roll coating. The emulsion-wet metal is then cold-formed. In the case of successive forming operations, as in successive wire drawing operations or in drawing and ironing can bodies, the emulsion can be applied prior to or during each operation.

It is, therefore, an important object of this invention to provide a water-based coolant-lubricant for metal to be cold-formed, the coolant-lubricant containing reactive lubricating components, such as oleic acid an an ethanolamine and other lubricating components, such as mineral oils or waxes, which are emulsified by a mixture of emulsifiers having both oleophilic and hydrophilic characteristics into an aqueous emulsion stable over a wide pH range and capable of substantial dilution prior to use.

Another important object is the provision of an aqueous coolant-lubricant wherein as much as about 180 parts of lubricant per liter of emulsion can be effectively emulsified by about 70 parts of emulsifier per liter of emulsion, the emulsifier comprising a mixture of a partial sodium salt of an alkylpolyoxyethylene phosphate ester and a dialkylphenoxypoly(ethyleneoxy)ethanol.

It is a further important object of this invention to provide a method of cold-forming a metal by applying thereto an aqueous coolant-lubricant in the form of a stable emulsion containing from 25% to 2% solid ingredients and wherein the lubricating components are retained in the aqueous emulsion by a mixture of emulsifying agents having both hydrophilic and oleophilic characteristics.

DETAILED DESCRIPTION OF THE PREFERRED EMBODIMENTS

The amine component of the composition is an ethamolamine, preferably either monoethanolamine or triethanolamine. The oleic acid component is present approximately in stoichiometric proportions with the ethanolamine preferably with a small excess of oleic acid. The pH of the final emulsion is determine by the ethanolamine which is utilized. The pH utilizing monoethanolamine ranges from about 8.8 to about 9.5, with triethanolamine, the pH varies from about 7.5 to about 8.0.

The amount of the combination of ethamolamine plus oleic acid present in the composition is not critical on the high side, since the reaction product is easily emulsifiable. Thus, any excess of the reaction product does not materially affect the homogenity of the lubricant or its efficacy in use.

A combination of a heavy mineral oil with a light mineral oil or wax is utilized. The heavy mineral oil preferably has a viscosity in excess of about 8000 c.p.s. and is present to increase the viscosity of the total composition and to enhance the oil film strength of the coating on the metal being cold formed. It has been found that Valvata 85 or Vitrea 85 (products of Shell Chemical Co., Houston, Texas) are excellent heavy mineral oils for use in the present invention. These specific oils have viscosities of about 14,000 c.p.s.

Exemplary of a suitable light mineral oil, preferably having a viscosity of less than about 200 c.p.s. is Carnea 21 (also a product of Shell Chemical Co.). Carnea 21 has a viscosity of about 47 c.p.s.

As alternatives to the light mineral oil, a paraffin wax, specifically Eskar Wax R25 (a product of Amaco, Inc., Chicago, Illinois) or TS 254 wax (a product of Commercial Solvents Corporation, New York, New York) can be used. TS 254 wax is an oxazoline wax having the formula:

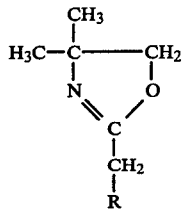

Where R is preferably the oleic acid ($C_{18}$) substitute, although other acid substitutes ranging from $C_{12}$ to $C_{24}$ may be utilized.

Igepal DM 710 (a product of GAF Corporation, New York, N.Y.) is dialkylphenoxypoly(ethyleneoxy)ethanol. This ingredient serves primarily as a hydrophilic emulsifier.

Gafac GB 520 (also a product of GAF Corp) is a partial sodium salt of an alkylpolyoxyethylene phosphate ester. This ingredient is primarily oleophilic and serves as both as emulsifier and as a lubricant.

It has been found that this combination of two emulsifiers is effective to form the stable emulsions of this invention. Non-stable emulsions result from the elimination of either one of the two emulsifiers, and the shelf life and the lubricant efficacy of the composition is materally reduced when the two emulsifiers are not utilized in combination.

The above ingredients were incorporated into several compositions, as follows:

COMPOSITION I

| Component | Parts by Weight |
|---|---|
| Oleic Acid | 47 |
| Carnea 21 | 98 |
| Monoethanol amine | 12 |
| Igepal DM 710 | 36 |
| Gafac GB 570 | 34 |
| Valvata 85 | 23 |
| Water | 750 |
| Total | 1000 |

COMPOSITION II

| Component | Parts by Weight |
|---|---|
| Oleic Acid | 47 |
| Carnea 21 | 98 |
| Triethanolamine | 12 |
| Igepal DM 710 | 36 |
| Gafac GB 520 | 34 |
| Valvata 85 | 23 |
| Water | 750 |
| Total | 1000 |

COMPOSITION III

| Component | Parts by Weight |
|---|---|
| Oleic Acid | 47 |
| TS 254 Wax | 98 |
| Triethanolamine | 12 |
| Igepal DM 710 | 36 |
| Gafac GB 520 | 34 |
| Valvata 85 | 23 |
| Water | 750 |
| Total | 1000 |

COMPOSITION IV

| Component | Parts by Weight |
|---|---|
| Oleic Acid | 47 |
| Eskar Wax R 25 | 98 |

COMPOSITION IV-continued

| Component | Parts by Weight |
|---|---|
| Triethanolamine | 12 |
| Igepal DM 710 | 36 |
| Gafac GB 520 | 34 |
| Valvata 85 | 23 |
| Water | 750 |
| Total | 1000 |

The above-identified Compositions I, II, III and IV were utilized as a coolant-lubricant in various cold forming operations as set forth in the following examples:

EXAMPLE 1

118 pound black-plate steel stock was treated with Reactobond 929, a reactive phosphate lubricant supplied by Oxy Metal Industries Corp. "Reactobond" is a registered trademark of Oxy Metal Industries Corp.

A Tinius Olsen Model A-12 Ductomatic testing machine was employed to form a can body consisting of a bottom and a sidewall having a final diameter of 26 mm. and a height of 50 mm. from an initial blank in the form of a disc having a diameter of 66 mm.

The final can body was formed in three steps:

(1) Deforming the disc having a diameter of 66 mm and a thickness of 0.014 inches into a cup having a diameter of 33 mm and of the same wall thickness as the initial disc.

(2) Drawing the sidewalls of the cup to a diameter of 26 mm and a wall thickness of 0.0125 inches.

(3) Finally ironing the walls to a thickness of 0.0092 inches.

Prior to each step, in the making of one series of can bodies, the metal surface was sprayed with Composition I. In the making of a second series of can bodies, the metal surface was sprayed prior to each step with a commercially available lubricant sold under the name Prosol 522.

It was found, in almost every instance, that lesser forming pressures were required to form the cam body from the metal treated with Composition I than from the metal treated with the commercially available lubricant.

EXAMPLE 2

Example 1 was repeated, except that both the lubricant of Composition I and the Prosol 522 were diluted 4-to-1 with water. In every instance the required forming pressures were less where the formulation of Composition I was utilized.

EXAMPLE 3

The lubricant of Composition I diluted 9-to-1 with water was used as the coolant-lubricant to iron can bodies to their final configuration in a 55-ton press. The beverage cans were made from 107 pound double reduced T-9, ¼ lb. tin plate stock. The results utilizing the diluted Composition I were far superior to those obtained with other lubricants currently used in commercial body makers. Similar results were also obtained using Composition I as the coolant-lubricant in the manufacture of beverage cans from T-4, ½ lb. tin plate.

EXAMPLE 4

118 pound T-1 and T-4 black plate sheets were coated with Reactobond 929 conversion coating at a coating density of 300 mg per square foot. Twenty-four hours after coating, drawn and iron cans were stamped from the coated sheets using the coolant-lubricant of Composition I diluted 9-to-1 with water, the coolant-lubricant being applied in each of the forming operations. Several hundred 413-211 two-piece beverage cans were made with excellent results.

EXAMPLE 5

Composition I, diluted 9-to-1 with water, was used as the coolant-lubricant to draw many coils of steel wire in a multi-hole Vaughn wet drawing machine. Two types of pre-treated wire were drawn, one type being Cuprobond coated steel wire and the other type being Reactobond treated steel wire. Both wires were drawn from an initial 0.080 inch diameter to 0.045 inch and to 0.035 inch diameters. Both types of wire drew well with a substantially less temperature increase utilizing Composition I as compared with the temperature increase using the competitive water emulsifiable lubricant Apex W.S. 113.

EXAMPLE 6

Composition I, diluted 9-to-1 with water, was utilized as the coolant-lubricant to draw steel wire coated with either Cuprobond or Reactobond from 0.045 inch to 0.010 inch at speeds up to 5000 feet per minute. The coolant-lubricant of Composition I ran noticably cooler than the normally used competitive coolant.

EXAMPLE 7

Examples 1 and 2 were repeated substituting Composition III for the original Composition I. Substantially identical results were obtained, with the exception that the formed body was more easily removed from the forming punch.

EXAMPLE 8

Example 7 was repeated with the substitution of Composition IV for Composition III. Comparable results were obtained.

EXAMPLE 9

Examples 5 and 6 were repeated, substituting Composition II for Composition I. Comparable results were obtained.

I claim:

1. A lubricant and coolant composition for application as an aqueous emulsion to a metal surface prior to cold forming, consisting essentially of: about 47 parts by weight oleic acid, about 12 parts by weight of an ethanolamine, about 23 parts by weight of a heavy mineral oil, about 36 parts by weight of dialkylphenoxypoly(ethyleneoxy)ethanol, about 34 parts by weight of a sodium salt of an alkylpoly oxyethylene phosphate ester, about 98 parts by weight of a light lubricating ingredient selected from the group consisting of a light mineral oil, paraffin wax and an oxazoline wax, and about 750 parts by weight water, the emulsion having a pH ranging from about 7 to about 9.5.

2. A composition as defined in claim 1, wherein the ethanolamine is monoethanolamine and the emulsion has a pH of from about 8.8 to about 9.5.

3. A composition as defined in claim 1, wherein the ethanolamine is triethanolamine and the emulsion has a pH ranging from about 7 to about 8.

4. The method of cold-forming a metal which comprises applying thereto, immediately prior to cold-forming, an aqueous emulsion consisting essentially of: about 47 parts by weight oleic acid, about 12 parts by weight of an ethanolamine, about 23 parts by weight of a heavy mineral oil, about 36 parts by weight of dialkylphenoxypoly (ethyleneoxy) ethanol about 34 parts by weight of a sodium salt of an alkylpoly oxyethylene phosphate ester, about 98 parts by weight of a light lubricating ingredient selected from the group consisting of a light mineral oil, paraffin wax and an oxazoline wax, and about 750 parts by weight water, the emulsion having a pH ranging from about 7 to about 9.5;

and cold-forming the blank while wet with said emulsion.

5. The method of claim 4, wherein the metal is zinc or copper coated, the ethanolamine is triethanolamine, and the pH of the emulsion, as applied, ranges from about 7 to about 8.

6. The method of claim 4, wherein the emulsion, as applied, contains from about 2% to about 25% solids.

* * * * *